US007972115B2

(12) United States Patent
Potier

(10) Patent No.: US 7,972,115 B2
(45) Date of Patent: Jul. 5, 2011

(54) MOVING BLADE FOR A TURBOMACHINE

(75) Inventor: Thomas Potier, Saran (FR)

(73) Assignee: SNECMA, Paris (FR)

( * ) Notice: Subject to any disclaimer, the term of this patent is extended or adjusted under 35 U.S.C. 154(b) by 922 days.

(21) Appl. No.: 11/870,614

(22) Filed: Oct. 11, 2007

(65) Prior Publication Data

US 2008/0175716 A1 Jul. 24, 2008

(30) Foreign Application Priority Data

Oct. 13, 2006 (FR) ..... 06 54257

(51) Int. Cl.
*F01D 5/14* (2006.01)

(52) U.S. Cl. ..... 416/228; 416/235; 416/241 R

(58) Field of Classification Search ..... 416/228, 416/235, 241 R
See application file for complete search history.

(56) References Cited

U.S. PATENT DOCUMENTS 4,830,315 A * 5/1989 Presz et al. ..... 244/200
5,282,721 A * 2/1994 Kildea ..... 416/97 R
5,403,158 A 4/1995 Auxier
7,290,986 B2 * 11/2007 Stegemiller et al. ..... 416/92
7,351,035 B2 * 4/2008 Deschamps et al. ..... 416/92
7,607,893 B2 * 10/2009 Lee et al. ..... 416/228
2002/0182074 A1 12/2002 Bunker
2004/0013515 A1 1/2004 Cherry et al.
2004/0096328 A1 5/2004 Soechting et al.
2004/0179940 A1 9/2004 Liang

FOREIGN PATENT DOCUMENTS

EP 1 650 404 A2 4/2006
GB 2 052 644 A 1/1981

* cited by examiner

*Primary Examiner* — Ninh H Nguyen
(74) *Attorney, Agent, or Firm* — Oblon, Spivak, McClelland, Maier & Neustadt, L.L.P.

(57) ABSTRACT

A turbomachine moving blade without a top platform, the blade including a fastener root (110) surmounted by an airfoil (112) that presents an end face (114), a pressure-side face (116), and a suction-side face, said fastener root and said end face being situated respectively at bottom and top ends of the blade that are spaced apart along the main axis (A) of the blade. The airfoil presents a projecting edge defined between a portion (124) of its end face and a top portion (122) of its pressure-side face, these portions forming between each other a mean edge angle that is strictly less than 90°. The top portion (122) of the pressure-side face is corrugated, and in a section plane perpendicular to the main axis of the blade, it follows an outline formed by an alternating succession of concave curves (129) and convex curves (131).

9 Claims, 7 Drawing Sheets

MOVING BLADE FOR A TURBOMACHINE

The invention relates to a moving blade for a turbomachine. It can be used in any type of turbomachine: turbojet, turboprop, terrestrial gas turbine . . . .

More particularly, the invention relates to a moving blade without a top platform. A blade is said to be without a top platform when it does not have a platform at its top end.

FIGS. 1 to 3 show a prior art type of moving blade without a top platform that is mounted on the rotor disk of a turbine (or of a compressor) in a turbojet.

That prior art blade 8 comprises a fastener root 10 surmounted by an airfoil 12, the airfoil presenting an end face 14 and pressure-side and suction-side faces 16 and 18, the fastener root 10 and said end face 14 being situated respectively at the bottom and top ends of the blade that are spaced apart along the main direction A of the blade, the blade 12 presenting at the top edge of its pressure side a projecting edge 20 defined between a portion 24 of its end face 14 and a top portion 22 of its pressure-side face 16, these portions 22 and 24 forming between each other a mean edge angle B. The mean edge angle is determined by taking the average of the edge angles measured at various points along the edge between the portions 22 and 24, each angle being measured in a plane perpendicular to the tangent to the edge at the point in question. In FIG. 2, for simplification purposes, it is assumed that the edge angle between the portions 22 and 24, as measured in the plane of FIG. 2, is equal to the mean edge angle B.

The turbojet has a rotor disk 26 with an axis of rotation R, and the blades 8 are distributed around the circumference of the disk 26 and they extend radially outwards from the disk. The main direction A of each blade 8 corresponds to a direction that is radial relative to the axis R. The blades 8 are surrounded externally by a casing ring 28, with a gap I (see FIG. 2) remaining between the end face 14 of each blade and said ring 28.

Upstream and downstream are defined in the present application relative to the flow direction of the stream F of air passing through the turbojet. References F1 and F2 designate respective components of the stream F in a plane perpendicular to the main direction A, such as the section plane III-III of FIG. 3, and in a plane parallel to the main direction A, such as the section plane II-II of FIG. 2.

A zone of turbulence C forms in the stream F downstream from the projecting edge 20 (see FIG. 2). Thus, in order to pass through the gap I, the stream F must go round the edge 20 and round the zone of turbulence C. When describing this phenomenon, it is said that the stream F "separates" from the blade at the edge.

It is generally desired to encourage such separation of the stream F in the gap I as much as possible since the greater the separation, the smaller the effective flow section for the stream F in the gap I, thereby reducing the fraction of the stream F that passes through the gap. This stream F that passes through the gap I does not contribute to the efficiency of the turbojet. By encouraging separation, the efficiency of the turbojet is improved, and consequently its fuel consumption is increased.

In order to encourage separation, it is known to select the mean edge angle B to be strictly less than 90°, as shown in FIGS. 1 to 3, and as in prior art examples of blades as described in FR 05/04811 and U.S. Pat. No. 6,672,829.

The invention seeks to further encourage separation of the stream at the edge.

To achieve this object, the invention provides a turbomachine moving blade without a top platform, the blade comprising a fastener root surmounted by an airfoil, the airfoil presenting an end face and pressure-side and suction-side faces, the fastener root and said end face being situated respectively at bottom and top ends of the blade that are spaced apart along the main axis of the blade, the airfoil presenting a projecting edge at the top edge of its pressure side, the projecting edge being defined between a portion of its end face and a top portion of its pressure-side face, these portions forming between each other a mean edge angle that is strictly less than 90° so as to encourage the stream of fluid passing through the turbomachine to separate at said edge, the blade being characterized in that the top portion of the pressure-side face is corrugated and, in any section plane perpendicular to the main axis of the blade, follows an outline formed by an alternating succession of concave curves and convex curves.

In the present application, a curve is considered as being concave when its bulging portion extends towards the suction-side face of the blade. Conversely, a curve is considered as being convex when its bulging portion extends away from the suction-side face of the blade.

Thus, said pressure-side face presents bulging zones defined by said convex curves stacked in the main direction of the blade, and set-back zones defined by said concave curves stacked in the main direction of the blade.

Thus, said outline presents alternating segments that slope gently and steeply in alternation relative to the components of the fluid stream in said section plane (under normal operating conditions of the turbomachine), and said top portion of the pressure-side wall of the blade presents zones that are inclined gently and steeply relative to the stream, these zones being defined by said gently-inclined and steeply-inclined segments stacked in the main direction of the blade.

Said gently-inclined zones guide the stream towards the steeply-inclined zones. Thus, the major portion of the stream passes via the steeply-inclined zones prior to going past said edge. However, for the stream passing via said steeply-inclined zones, the edge angle to be gone past (the angle "seen" by the stream) is smaller than it would be if said top portion were smooth (i.e. without corrugations). Since separation increases with decreasing size of the edge angle that the stream goes past, better separation is obtained with said corrugated top portion than with a smooth portion. This thus reduces losses of stream through the gap I.

Advantageously, said gently-inclined segments are oriented along the components of the stream in the section plane (under normal operating conditions of the turbomachine), such that, with said components, they form an angle that is close to 0°. In this way, the stream does not pass via the gently-inclined zones before going past said edge (it does not "see" them) and passes almost exclusively via the steeply-inclined zones.

Advantageously, said steeply-inclined segments are oriented transversely relative to the components of the stream in the section plane (under normal operation conditions of the turbomachine), such that relative to these components they form an angle close to 90°. It is in this orientation that the edge angle that the stream is to go past is at its smallest, and thus that stream separation in the gap is at its greatest. In other words, separation is greatest when the steeply-inclined zones face the components of the fluid stream in said section plane.

The invention and its advantages can be better understood on reading the following detailed description. The description refers to the accompanying figures, in which:

FIGS. 1 to 3 are described above.

Figure 1:
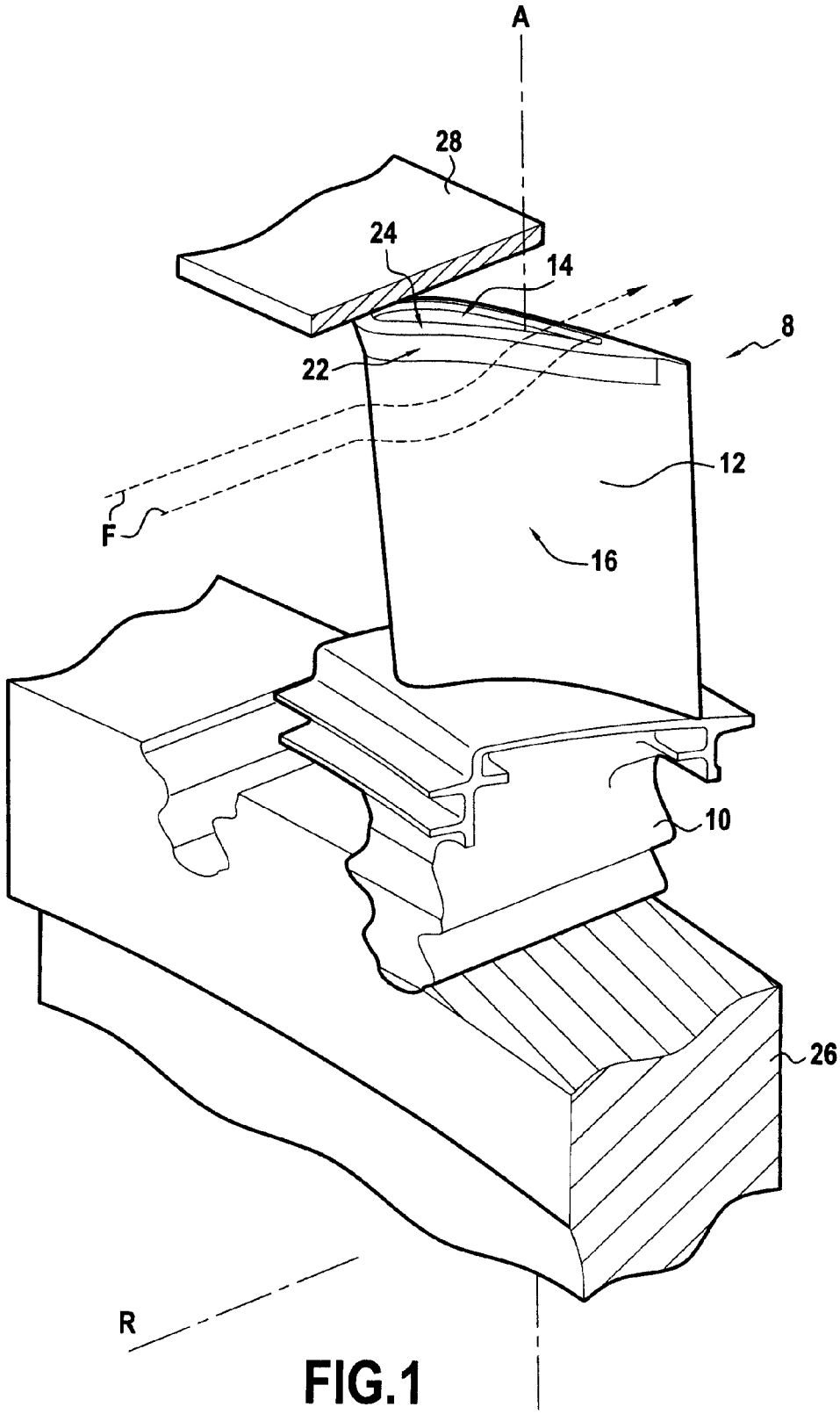
FIG. 1 is a perspective view of a portion of a turbojet fitted with a blade of prior-art type.
Figure 2:
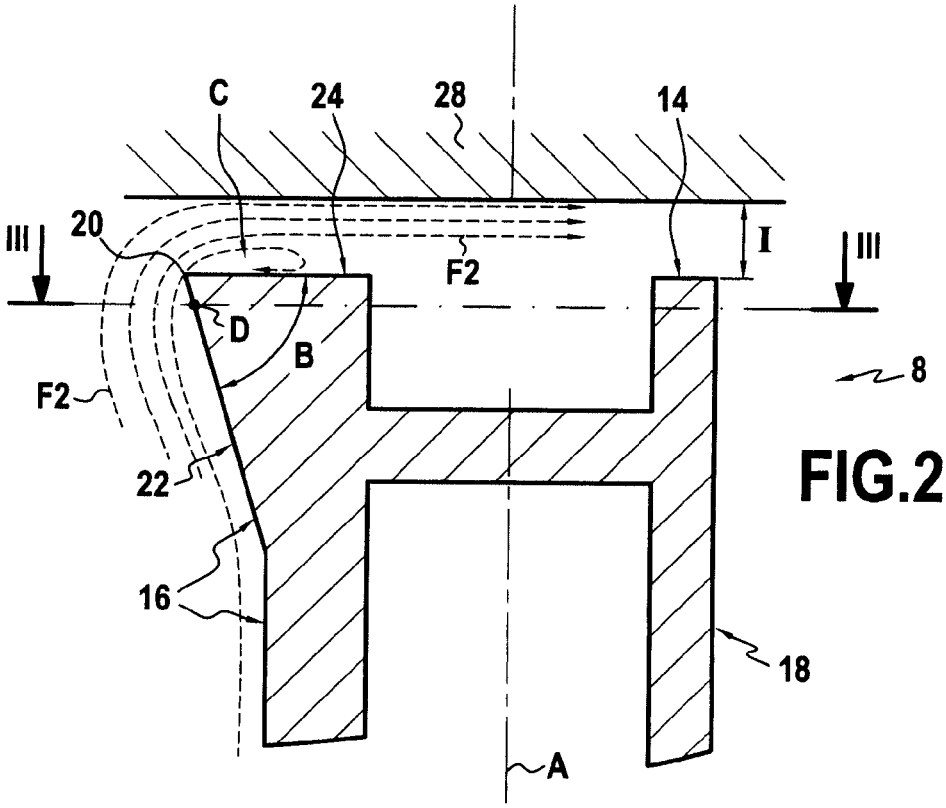
FIG. 2 shows the FIG. 1 blade in section on plane II-II, which plane is perpendicular to the tangent to the edge of the blade at point D.
Figure 3:
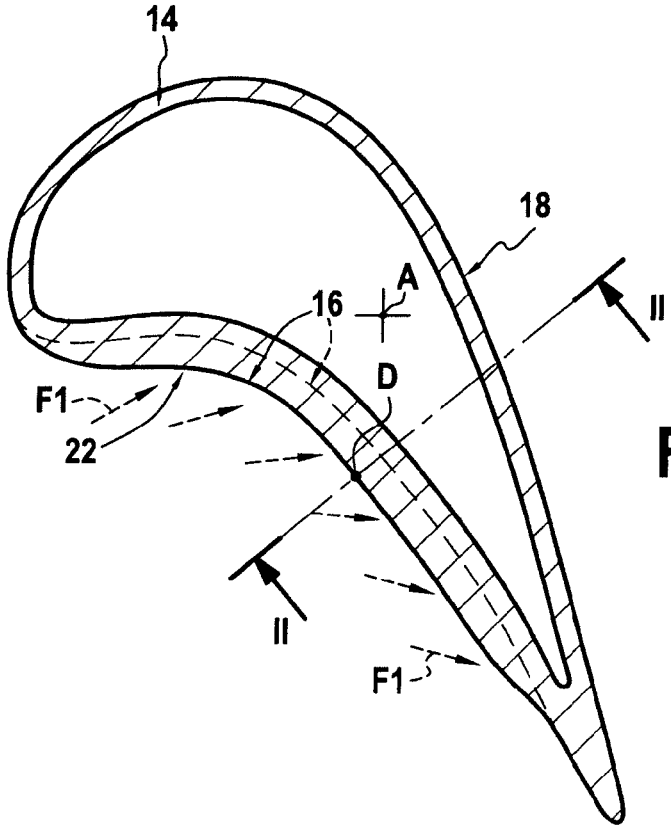
FIG. 3 shows the FIG. 1 blade in section on plane III-III, which plane is perpendicular to the main direction A of the blade, intersecting the top portion of the pressure-side face of the blade, and containing the point D.
Figure 4:
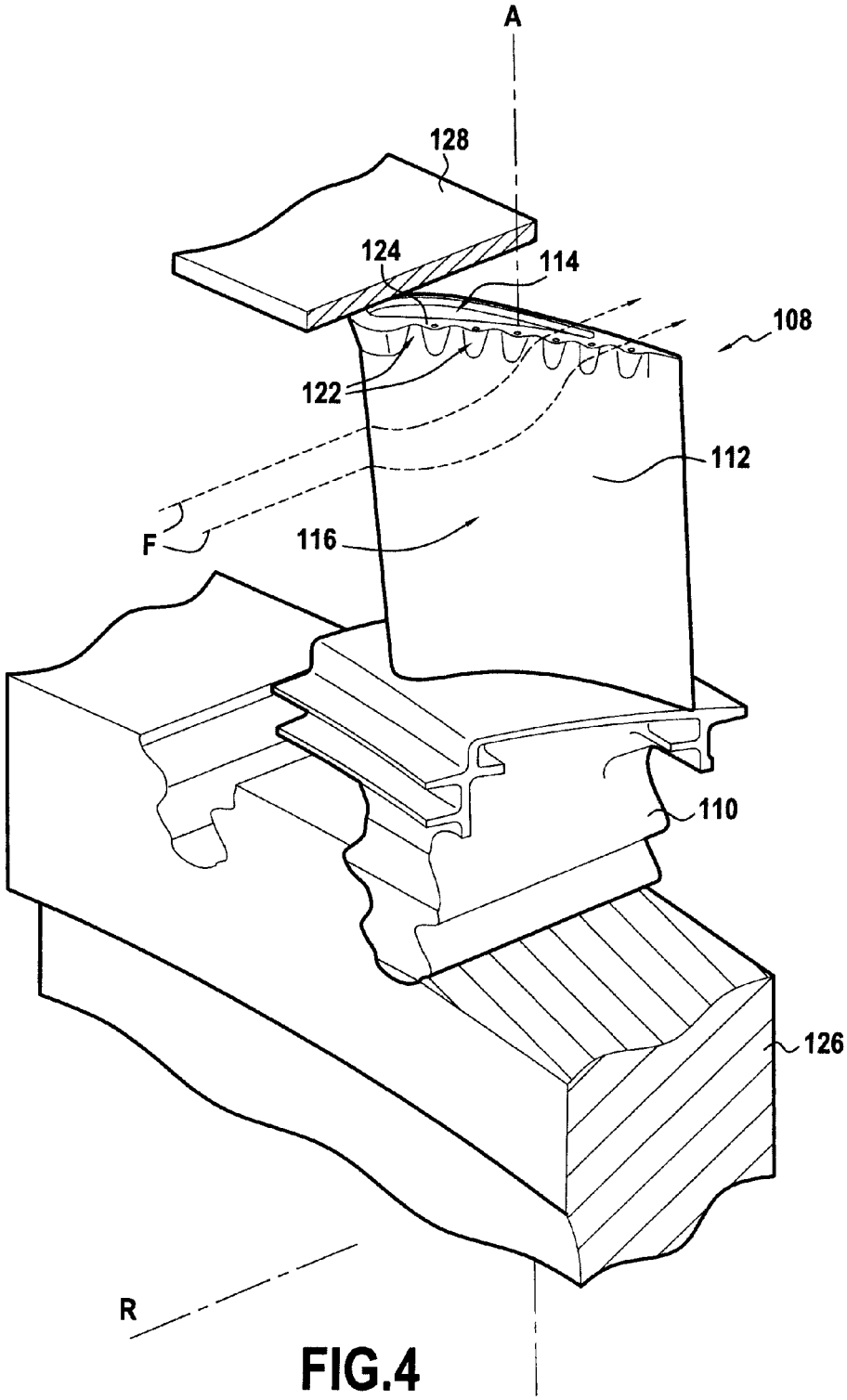
FIG. 4 is a perspective view of a portion of a turbojet fitted with a first embodiment of a blade of the invention.
Figure 5:
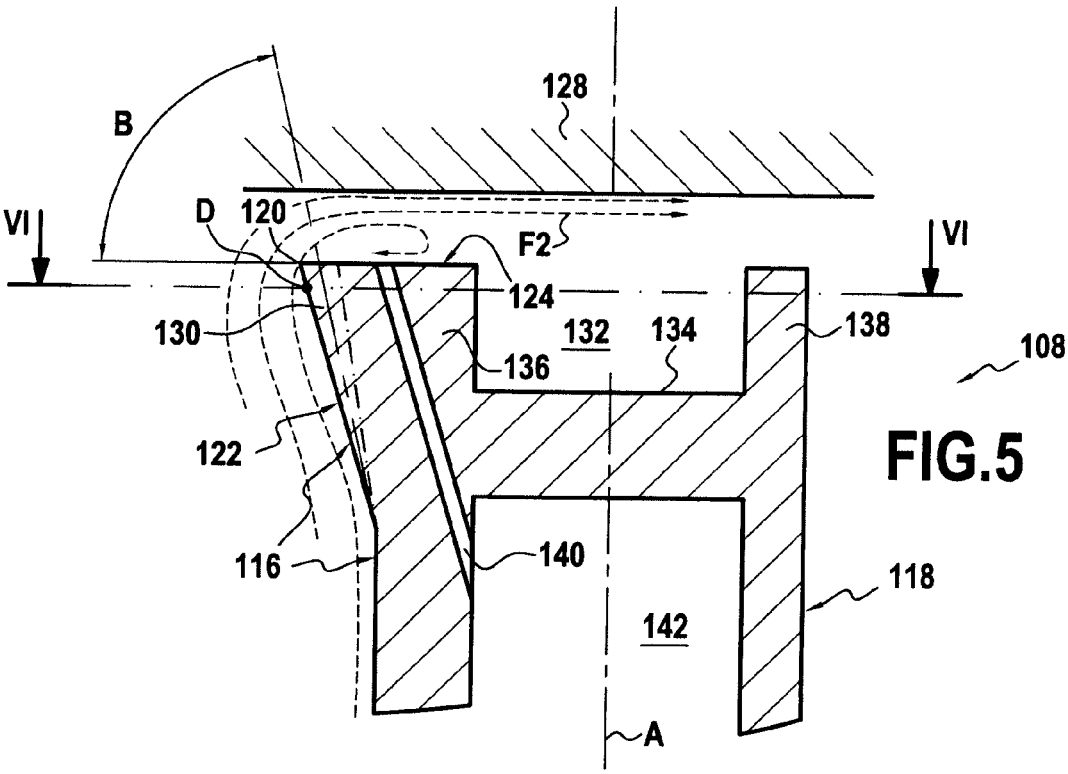
FIG. 5 shows the FIG. 4 blade in section on plane V-V, which plane is perpendicular to the tangent at the edge of the blade at point D.
Figure 6:
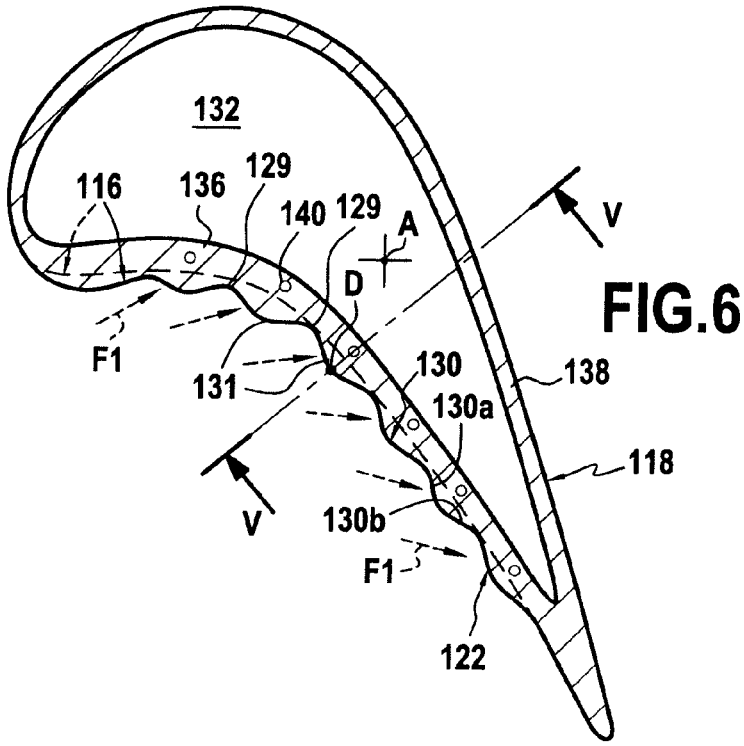
FIG. 6 shows the FIG. 4 blade in section on plane VI-VI, which plane is perpendicular to the main direction A of the blade, intersecting the corrugated top portion of the pressure-side face of the blade and containing the point D.

With reference to FIGS. 4 to 6, there follows a description of a first embodiment of a blade 108 of the invention. Elements that are analogous between this blade 108 and the blade of FIGS. 1 to 3 are identified by the same numerical references plus 100.

The blade 108 differs from the blade 8 in the top portion 122 of its pressure-side wall 116.

The blade 108 has a fastener root 110 surmounted by an airfoil 112, the airfoil presenting an end face 114 and pressure-side and suction-side faces 116 and 118. The fastener root 110 and the end face 114 are situated respectively at the bottom end and at the top end 108 taken along the main direction A of the blade. At the top edge of its pressure side, the airfoil 112 presents a projecting edge 120 defined between a portion 124 of the end face 114 and a top portion 122 of the pressure-side face 116. The portions 122 and 124 form between them a mean edge angle B that is strictly less than 90°.

In accordance with the invention, the top portion 122 of the pressure-side face is corrugated such that in any section plane perpendicular to the main direction A of the blade, and in particular in the section plane VI-VI, it follows an outline 130 formed by a succession of curves 129, 131 which are alternately concave and convex. Thus, this outline 130 presents alternating segments 130*a* and 130*b* that are respectively gently inclined and steeply inclined relative to the components F1 of the stream F in the section plane under consideration, here the plane VI-VI.

The gently-inclined segments 130*b* are oriented generally along the components F1 of the stream in the section plane VI-VI, while the deeply-inclined segments 130*a* are oriented generally transversely relative to the components F1 of the stream in this plane. In this way, the stream F passes almost exclusively along the steeply-inclined segments 130*a* before passing through the gap I. Since the steeply-inclined segments 130*a* face the stream F (more precisely the components F1 of the stream), separation of the stream F at the edge 120 is improved, compared with the separation obtained in the example of FIGS. 1 to 3.

In the example of FIGS. 4 to 6, the blade 108 includes at its top end an open cavity 132 defined by an end wall 134, a pressure-side rim 136, and a suction-side rim 138. Said projecting edge 120 is formed on the pressure-side rim 136 between the end face of said rim (corresponding to said portion 124 of the end face 114) and the pressure-side face of said rim (forming part of said top portion 122 of the pressure-side face 116).

In this embodiment, it should also be observed that the blade includes an internal cooling passage 142 and at least one cooling channel 140 communicating with said cooling passage 142.

Advantageously, the channel 140 opens out in said portion 124 of the end face, in register with the bulging corrugated zones of the top portion 122 of the pressure-side face, i.e. in register with the convex curves 131 of the outline 130 (see FIG. 6). It is in these bulging zones that there is more material, thus making it easier to form the channel 140 (e.g. by drilling).

Figure 7:
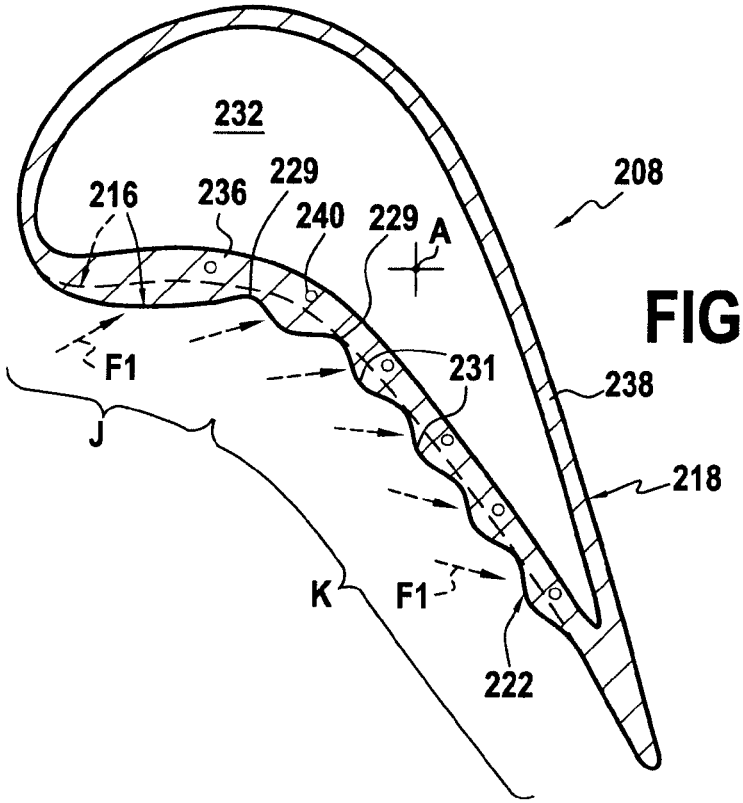
FIG. 7 is a section view analogous to that of FIG. 6, showing a second embodiment of a blade of the invention.

With reference to FIG. 7, there follows a description of a second embodiment of a blade 208 of the invention. Elements that are analogous between this blade 208 and the blade of FIGS. 4 to 6 are identified by the same numerical references, plus 100.

The blade 208 of FIG. 7 differs from that of FIGS. 4 to 6 in the corrugated top portion 222 of the pressure-side face 216. This top portion 222 begins quite a long way from the leading edge of the blade.

This takes account of the fact that only a small portion of the stream passes through the gap I in the zone J that is close to the leading edge of the blade. With reference to FIG. 7, it is estimated that approximately 20% of the stream passes through the gap I in the zone J, and thus that the remaining 80% of the stream passes through the gap I in the zone K. Consequently, the presence of corrugations in accordance with the invention (i.e. the succession of alternating concave and convex curves 229 and 231 along the outline 230), is of greatest use in the zone K. The zone J covers approximately one-fourth of the pressure-side face of the blade starting from the leading edge, while the zone K covers the remaining three-fourths.

Figure 8:
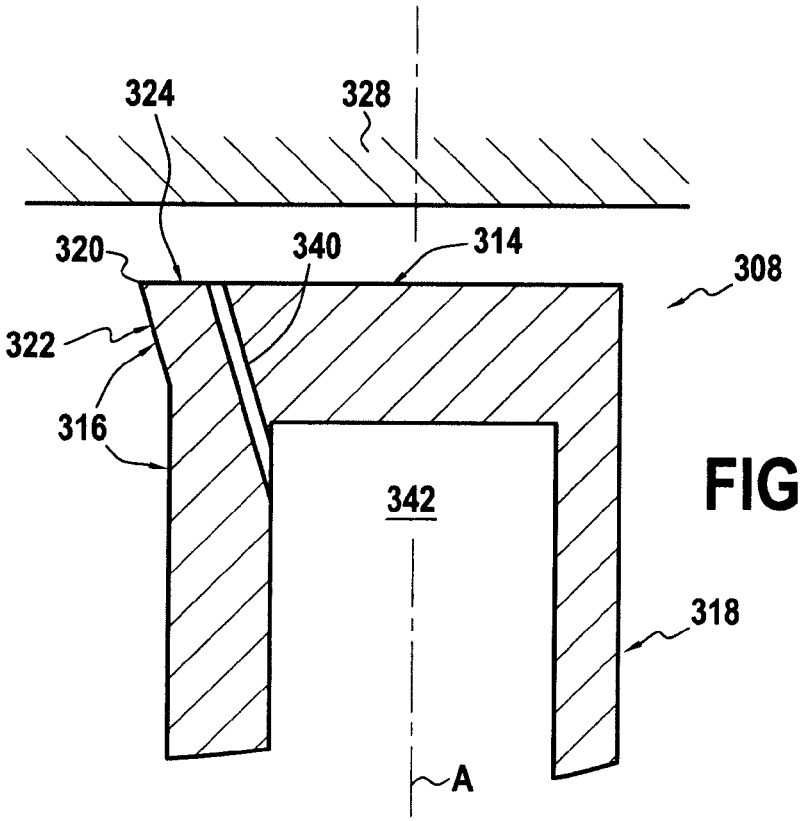
FIG. 8 is a section view analogous to that of FIG. 5, showing a third embodiment of a blade of the invention.

With reference to FIG. 8, there follows a description of a blade 308 of the invention. Elements that are analogous between this blade 308 and the blade of FIGS. 4 to 6 are identified by the same numerical references, plus 200.

The embodiment of FIG. 8 differs from the embodiment of FIGS. 4 to 6 in that the blade 308 does not have an open cavity in its top end, and consequently presents neither a pressure-side rim nor a suction-side rim.

Figure 9:
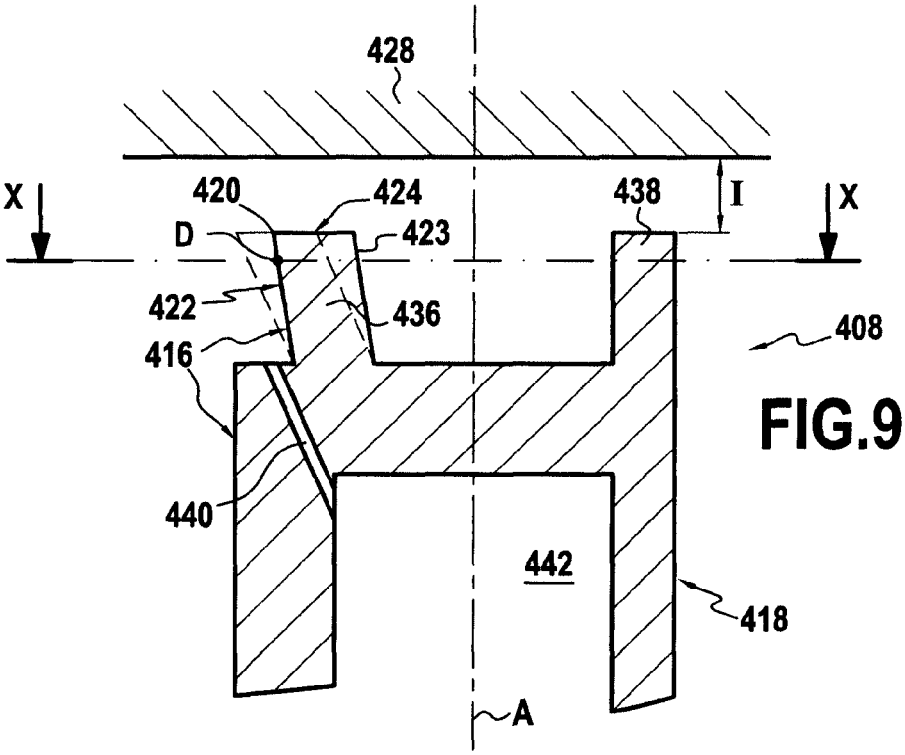
FIG. 9 is a section view analogous to that of FIG. 5, showing in section on plane IX-IX, a fourth blade of the invention.

With reference to FIG. 9, there follows a description of a fourth embodiment of a blade 408 of the invention. Elements that are analogous between this blade 408 and the blade of FIGS. 4 to 6 are identified by the same numerical references, plus 300.

The blade 408 of FIG. 9 differs from the embodiment of FIGS. 4 to 6 in that its pressure-side rim 436 is set back relative to the remainder of the pressure-side face. The top portion 422 of the pressure-side face 416 corresponds to the pressure-side face of the pressure-side rim 436.

Thus, whereas in the first three embodiments, the top portion 122, 222, 322 of the pressure-side face 116, 216, 316 overhangs relative to the remainder of the pressure-side face of the blade, in this fourth embodiment, the top portion 422 of the pressure-side face 416 is set back relative to the remainder of the pressure-side face of the blade.

The top portion 422 co-operates with the portion 424 of the end face of the blade to form a mean edge angle B that is strictly less than 90°.

Furthermore, it should be observed in this fourth embodiment that the pressure-side rim 436 over its entire length is corrugated and slopes towards the pressure side (thus, even the suction-side wall 423 of the rim 436 is corrugated). The pressure-side rim 436 may be corrugated along its entire length, i.e. from the leading edge to the trailing edge of the blade, or over a portion only of its length.

Like the embodiment of FIG. 5, the blade embodiment of FIG. 9 has an internal cooling passage 440 and cooling channels 442 communicating with said passage. In contrast, the cooling channels 440 do not open out in the portion 424 of the end face of the blade, but at the base of the pressure-side rim 436, in the setback zones of the corrugation of said rim, i.e. in register with the concave curves 429 of the outline 430. It is easier to make the cooling channels 440 in this location. In addition, the cooling air delivered by the channels 440 rises along the top portion 422 of the pressure-side wall (and thus serves to cool this wall) before reaching the gap I.

Figure 11:
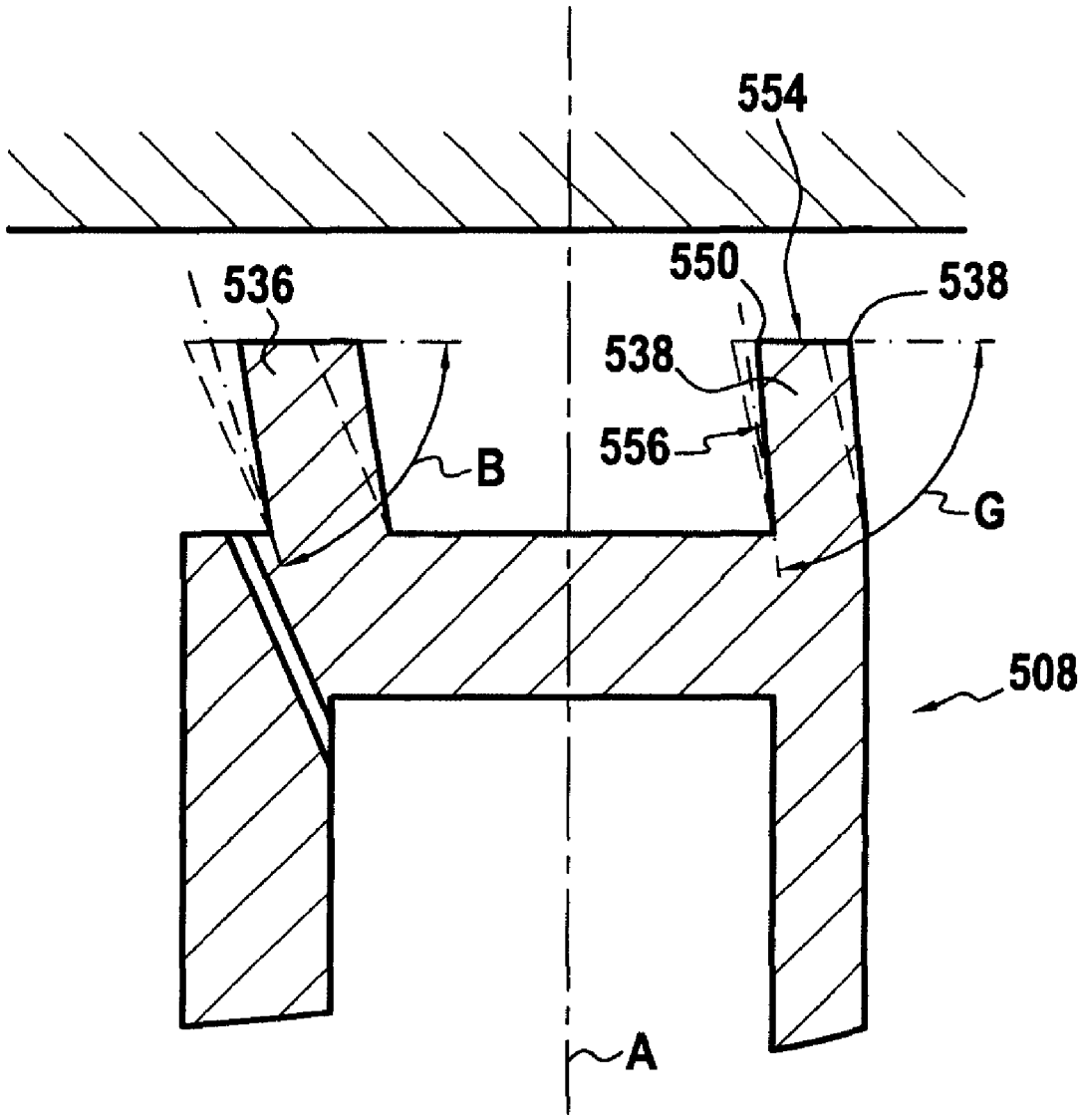
FIG. 11 is a section view analogous to that of FIG. 5, showing a fifth embodiment of a blade of the invention.

With reference to FIG. 11, there follows a description of a fifth embodiment of a blade 508 of the invention. Elements that are analogous between this blade 508 and the blade of FIGS. 4 to 6 are identified by the same numerical references plus 400.

Figure 10:
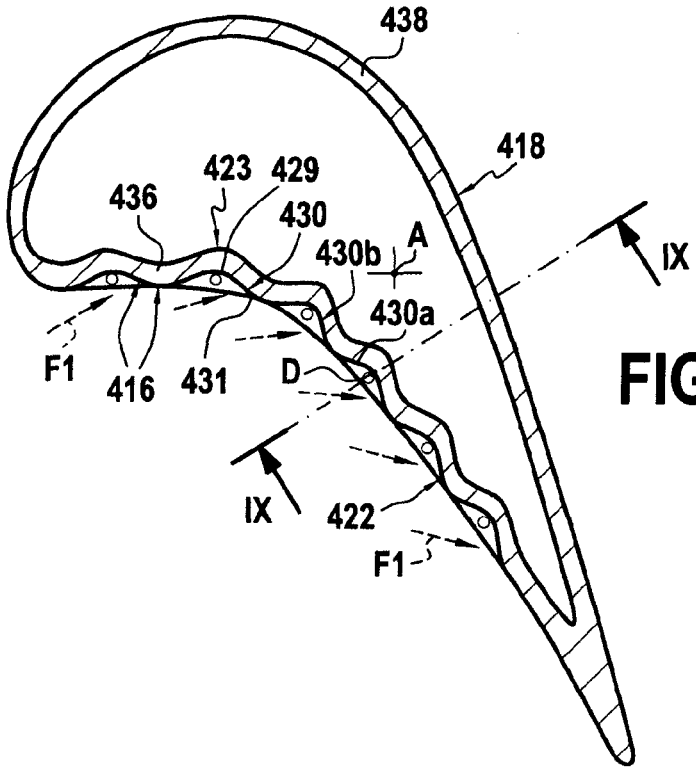
FIG. 10 is a section view analogous to that of FIG. 6 on plane X-X, showing the blade of FIG. 9.

The blade 508 of FIG. 11 differs from the blade of FIGS. 9 and 10 in that the suction-side rim 538 of the blade is corrugated and inclined towards the pressure side, like the pressure-side rim 536. Thus, another projecting edge 550 is defined between the end face 554 and the pressure-side face 556 of the suction-side rim 538. Between them, these portions form a mean edge angle G that is strictly less than 90° so as to encourage the stream F of fluid passing through the turbomachine over the edge 550 to separate. The pressure-side face 556 of the suction-side rim 538 is corrugated, and in any section plane perpendicular to the main axis A of the blade it follows an outline formed by a succession of alternating concave curves and convex curves, such that said outline presents alternating segments that are gently inclined and steeply inclined relative to the components F1 of the stream F in said section plane.

In the above embodiments, a blade is described that forms part of a turbine rotor in a turbojet. Nevertheless, it is clear that the invention can be applied to other types of turbomachine, since efficiency losses associated with the stream F passing via the gap I are to be found in other types of turbomachine.

The invention claimed is:

1. A turbomachine moving blade without a top platform, the blade comprising a fastener root surmounted by an airfoil, the airfoil presenting an end face and pressure-side and suction-side faces, the fastener root and said end face being situated respectively at bottom and top ends of the blade that are spaced apart along the main axis of the blade, the airfoil presenting a projecting edge at the top edge of its pressure side, the projecting edge being defined between a portion of its end face and a top portion of its pressure-side face, these portions forming between each other a mean edge angle that is strictly less than 90° so as to encourage the stream of fluid passing through the turbomachine to separate at said edge, wherein the top portion of the pressure-side face is corrugated and, in any section plane perpendicular to the main axis of the blade, follows an outline formed by an alternating succession of concave curves and convex curves.

2. A turbomachine blade according to claim 1, in which said top portion of the pressure-side face projects relative to the remainder of the pressure-side face of the blade.

3. A turbomachine blade according to claim 1, having at its top end an open cavity defined by an end wall, a pressure-side rim, and a suction-side rim, and in which said projecting edge is formed on the pressure-side rim between the end face and the corrugated pressure-side face of the pressure-side rim.

4. A turbomachine blade according to claim 3, in which the pressure-side rim is corrugated and inclined towards the pressure side.

5. A turbomachine blade according to claim 4, including an internal cooling passage and at least one cooling channel communicating with the internal cooling passage, said channel opening out at the base of the pressure-side rim, in register with set back zones of the corrugation of said rim.

6. A turbomachine blade according to claim 3, in which another projecting edge is defined between the end face and the pressure-side face of the suction-side rim, these portions forming between them a mean edge angle that is strictly less than 90° so as to encourage the stream of fluid passing through the turbomachine to separate at said other edge, and in which the pressure-side face of the suction-side rim is corrugated and, in any section plane perpendicular to the main axis of the blade, follows an outline formed by an alternating succession of concave curves and convex curves.

7. A turbomachine blade according to claim 1, including an internal cooling passage and at least one cooling channel communicating with said internal cooling passage, the channel opening out in said portion of the end face in register with bulging zones in the corrugation of the top portion of the pressure-side face.

8. A turbine including a blade according to claim 1.

9. A turbomachine including a turbine according to claim 8.

* * * * *